US009017049B2

(12) United States Patent
Gasperini et al.

(10) Patent No.: US 9,017,049 B2
(45) Date of Patent: Apr. 28, 2015

(54) VARIABLE DISPLACEMENT LUBRICANT PUMP

(75) Inventors: Matteo Gasperini, Lavaiano-Fraz. Lari (IT); Stefano Fiorini, Rochester Hills, MI (US); Massimiliano Lazzerini, San Pietro in Palazzi (IT); Raffaele Squarcini, Livorno (IT)

(73) Assignee: Pierburg Pump Technology GmbH, Neuss (DE)

( * ) Notice: Subject to any disclaimer, the term of this patent is extended or adjusted under 35 U.S.C. 154(b) by 224 days.

(21) Appl. No.: 13/700,136

(22) PCT Filed: May 28, 2010

(86) PCT No.: PCT/EP2010/057378

§ 371 (c)(1),
(2), (4) Date: Nov. 27, 2012

(87) PCT Pub. No.: WO2011/147457

PCT Pub. Date: Dec. 1, 2011

(65) Prior Publication Data

US 2013/0071275 A1 Mar. 21, 2013

(51) Int. Cl.

| | |
|---|---|
| ***F04C 2/344*** | (2006.01) |
| ***F04C 14/22*** | (2006.01) |
| ***F04C 14/24*** | (2006.01) |
| ***F04C 15/00*** | (2006.01) |

(52) U.S. Cl.

CPC ..... *F04C 2/3441* (2013.01); *F04C 14/226* (2013.01); *F04C 14/24* (2013.01); *F04C 15/0049* (2013.01)

(58) Field of Classification Search

CPC .. F01C 21/108; F04C 14/226; F04C 15/0049; F04C 2270/13; F04C 14/24; F04C 2/3441

USPC ..... 418/157, 30, 26

See application file for complete search history.

(56) References Cited

U.S. PATENT DOCUMENTS

| | | | | |
|---|---|---|---|---|
| 4,531,893 | A | 7/1985 | Okoh et al. | |
| 5,895,209 | A | 4/1999 | Miyazawa | |
| 7,682,135 | B2 * | 3/2010 | Ueki et al. | 418/30 |

(Continued)

FOREIGN PATENT DOCUMENTS

| | | | | |
|---|---|---|---|---|
| DE | 39 13 414 | A1 | 10/1990 | |
| DE | 3913414 | A1 * | 10/1990 | F04C 15/04 |

(Continued)

*Primary Examiner* — Mary A Davis
(74) *Attorney, Agent, or Firm* — Norman B. Thot

(57) ABSTRACT

A variable displacement lubricant pump for providing a pressurized lubricant for an internal combustion engine includes a shiftable control ring. The control ring comprises a plurality of pump chambers and a pressure relief valve. The plurality of pump chambers rotate through a charge zone and a discharge zone. A pump rotor comprises radially slidable vanes. The pump rotor rotates in the control ring. A pretensioning element pushes the control ring to a high pumping volume direction. A first control chamber pushes the control ring to a low pumping volume direction. A second control chamber pushes the control ring to the high pumping volume direction. A pump outlet is connected to the first control chamber. A throttle valve connects the first control chamber with the second control chamber. The pressure relief valve of the control ring connects the discharge zone to the second control chamber.

9 Claims, 1 Drawing Sheet

(56) References Cited

U.S. PATENT DOCUMENTS

| | | | |
|---|---|---|---|
| 2008/0107554 | A1 | 5/2008 | Shulver et al. |
| 2010/0329912 | A1 | 12/2010 | Williamson et al. |

FOREIGN PATENT DOCUMENTS

| | | | |
|---|---|---|---|
| JP | 5-79469 | A | 3/1993 |
| JP | 7-119648 | A | 5/1995 |

* cited by examiner

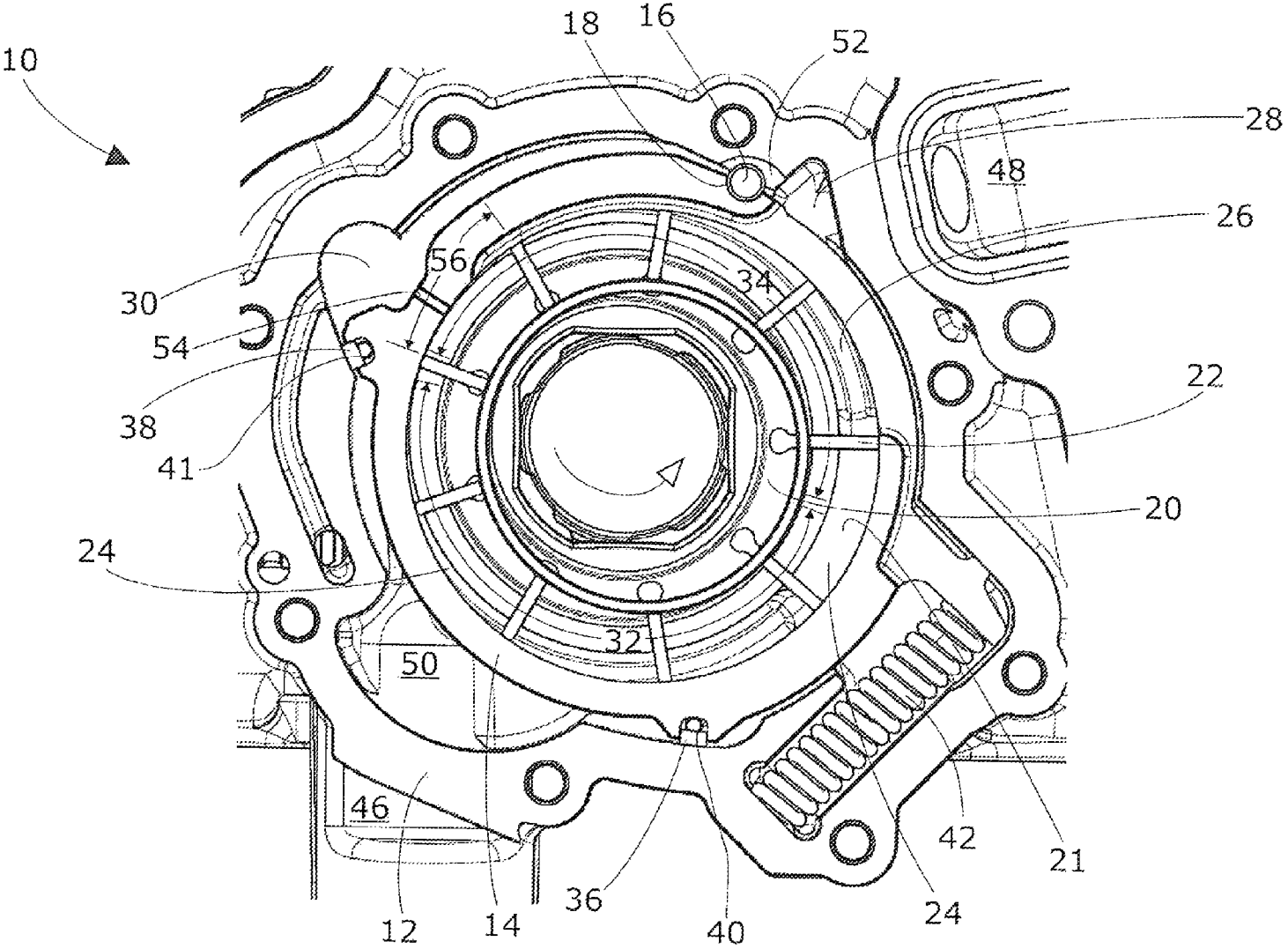
28
26
22
20
21
48
42
24
52
34
40
16
18
32
36
14
56
50
12
46
30
54
38
41
24
10

VARIABLE DISPLACEMENT LUBRICANT PUMP

CROSS REFERENCE TO PRIOR APPLICATIONS

This application is a U.S. National Phase application under 35 U.S.C. §371 of International Application No. PCT/EP2010/057378, filed on May 28, 2010. The International Application was published in English on Dec. 1, 2011 as WO 2011/147457 A1 under PCT Article 21(2).

FIELD

The present invention relates to a variable displacement lubricant pump for providing pressurized lubricant for an internal combustion engine.

BACKGROUND

The mechanical pump comprises a pump rotor with radially slidable vanes rotating in a shiftable control ring, whereby the control ring envelopes numerous pump chambers. The shifting of the control ring is not necessarily a linear movement, but can also be a pivoting movement. The pump chambers rotate through a charge and a discharge zone inside the control ring. The pump further comprises a pretensioning element which pushes the control ring to a high pumping volume direction. A first control chamber pushes the control ring to a low pumping volume direction, and a second control chamber pushes the control ring to a high pumping volume direction if the lubricant is pressurized. The pump also comprises a pump outlet which is connected to the first control chamber. Both control chambers, i.e., the first and the second control chamber, are connected to each other via a throttle valve. Both control chambers can have a different circumferential extend around the control ring, so that the effective surfaces of the two control chambers and the respective moment arms are different. Both control chambers act against each other, i.e., act in different pumping volume directions.

WO 2006 066405 A1 describes a pump where the displacement of the lubricant is controlled by the eccentricity of the control ring. The eccentricity of the control ring is controlled by the equilibrium forces between the first control chamber, the second control chamber and the pretensioning element. When the pump rotor rotates in the control ring, the pump rotor causes a compression of the lubricant in the discharge zone. The lubricant is compressed at maximum in the discharge pump chamber which is located at the end of the discharge zone, i.e., the pump chamber with the minimum volume in the discharge zone. This maximum compression of the lubricant can cause high local pressure peaks, especially at high rotating speeds and if the control ring is positioned at a high pumping volume position, so that the equilibrium forces between the first control chamber, the second control chamber and the pretensioning element are temporarily disturbed. As a consequence, the lubricant flow rate can be temporarily incorrect and not adapted to the engine demand.

SUMMARY

An aspect of the present invention is to provide a variable displacement lubricant pump with an improved flow control quality at high rotating speed.

In an embodiment, the present invention provides a variable displacement lubricant pump for providing a pressurized lubricant for an internal combustion engine includes a control ring which is configured to be shiftable. The control ring comprises a plurality of pump chambers and a pressure relief valve. The plurality of pump chambers are configured to rotate through a charge zone and a discharge zone. A pump rotor comprises vanes configured to be radially slidable. The pump rotor is configured to rotate in the control ring. A pretensioning element is configured to push the control ring to a high pumping volume direction. A first control chamber is configured to push the control ring to a low pumping volume direction. A second control chamber is configured to push the control ring to the high pumping volume direction. A pump outlet is connected to the first control chamber. A throttle valve is configured to connect the first control chamber with the second control chamber. The pressure relief valve of the control ring connects the discharge zone to the second control chamber.

BRIEF DESCRIPTION OF THE DRAWINGS

The present invention is described in greater detail below on the basis of embodiments and of the drawings in which:

FIG. 1 shows a cross-sectional view of a variable displacement lubricant pump.

DETAILED DESCRIPTION

The control ring of the mechanical variable displacement lubricant pump is provided with a pressure relief valve which directly connects the discharge zone to the second control chamber.

The pressure relief valve forms a second connection of the discharge zone inside the control ring to the second control chamber. The pressure relief valve avoids effectively local differential pressure peaks in the discharge zone. The pressure relief valve allows only a calibrated leakage of the lubricant from the discharge zone to the second control chamber so that the pressures between the second control chamber and the discharge zone still remain different, but without high differential pressure peaks. As a consequence, the equilibrium forces between the first control chamber, the second control chamber and the pretensioning element remain undisturbed so that the control of the lubricant flow rate remains adapted to the engine's demand.

In an embodiment of the present invention, the pressure relief valve can, for example, be a radial groove in the control ring. A radial groove in the control ring is simple to realize and is cost-efficient. The leakage of the lubricant from the discharge zone to the second control chamber can further be calibrated by the area of the cross-section of the radial groove. The calibrated leakage allows only a minimal lubricant relief flow. The minimal lubricant relief flow avoids high local differential pressure peaks, but maintains the different operating pressures between the second control chamber and the discharge zone.

In an embodiment of the present invention, the pressure relief valve can, for example, be arranged at a final sector of the discharge zone. In this sector, a maximum compression of the lubricant appears in the pump chamber, especially when the control ring is positioned in a high pumping volume position. The final sector of the discharge is the region next to the vertex point where the discharge action turns to the charge action. The pressure relief valve, i.e., a radial groove in the control ring, allows a calibrated leakage so that high differential pressure peaks in this most susceptible sector can effectively be avoided.

In an embodiment of the present invention, the shiftable control ring can, for example, be pivotably supported by a fulcrum pin. The term "shiftable" is not restricted to a linear movement of the control ring. The shiftable control ring is pivotable in a defined radius. The fulcrum pin is arranged between the two control chambers, i.e., the first and the second control chamber.

In an embodiment of the present invention, the first control chamber can, for example, be defined between the fulcrum pin and a first sealing element, and the second control chamber can, for example, be defined between the fulcrum pin and a second sealing element.

In an embodiment of the present invention, the throttle valve can, for example, be positioned adjacent to the fulcrum pin to bypass the fulcrum pin which so as to forms a seal between the first and the second control chamber.

In an embodiment of the present invention, the pump outlet can, for example, be directly connected with the first control chamber. The direct connection between the first control chamber and the pump outlet can be realized by an opening which avoids any pressure drop even at high lubricant flow rates through the opening.

In an embodiment of the present invention, the pretensioning element can, for example, be a mechanical metal spring.

FIG. 1 shows a variable displacement lubricant pump 10 for an internal combustion engine. The lubricant pump 10 is adapted to supply an internal combustion engine with a lubricant, and more particularly, with a lubricant discharge pressure which should not depend proportionally on the rotational pump speed.

The variable displacement lubricant pump 10 comprises a metal housing 12 in which a shiftable control ring 14 is arranged axially between two side walls (not shown). The control ring 14 is provided with a pivot axis 16 at which the control ring 14 pivots, so that the control ring 14 is shifted between a low and a high pumping volume position. The pivot axis 16 is realized by a fulcrum pin 18.

The metal housing 12 contains a pump rotor 20 with numerous radially slidable vanes 22, whereby the vanes 22 rotate inside the control ring 14. The control ring 14 surrounds numerous rotating pump chambers 24 which are separated by the vanes 22. The pump chambers 24 with an increasing chamber volume define a charge zone 32 and the pump chambers 24 with a decreasing chamber volume define a discharge zone 34.

The pump rotor 20 is provided with a protrusion (not shown) which protrudes axially to the outside of one of the side walls. The protrusion of the pump rotor 20 can be rotated by a pump actuator which is not shown. Both the pump rotor 20 and the control ring 14 sit on a supporting ring 21 which is mounted to one of the side walls (not shown). The supporting ring 21 is provided with a discharge opening 26 through which the lubricant is delivered from the pump chambers 24 to a pump outlet 48.

The position of the control ring 14 is determined by three elements, i.e., a pretensioning element 42 which is a mechanical preload metal spring, a first control chamber 28 and a second control chamber 30.

The two control chambers 28, 30 which are formed by the housing 12, the two side walls (not shown) and the control ring 14 have a different circumferential extend around the control ring 14 so that the effective surfaces of the two control chambers 28, 30 and the respective moment arms are different. Both control chambers 28, 30 are opposed to each other with respect to the pivot axis 16 or the fulcrum pin 18 of the control ring 14, respectively. The circumferential extend of the two control chambers 28, 30 is defined by two sealing elements 36, 38 which are form-fitted hold in respective axial slots 40, 41 of the control ring 14. Therefore, the two control chambers 28, 30 are separated from each other by the fulcrum pin 18 and are sealed at their circumferential ends by the two sealing elements 36, 38.

The pump 10 is provided with a pump inlet 46 and the pump outlet 48. The pump inlet 46 leads into an inlet prechamber 50 which is separated by the control ring 14 from the pump chambers 24. The inlet prechamber 50 is circumferentially restricted by the two sealing elements 36, 38. The connection between the inlet prechamber 50 and the pump chambers 24 can be realized, for instance, by radial recess-like openings (not shown) in the control ring 14. The pump outlet 48 of the pump 10 is directly connected with the first control chamber 28.

A throttle valve 52 is provided adjacent to the fulcrum pin 18. The throttle valve 52 connects the first control chamber 28 with the second control chamber 30 so that the lubricant bypasses the fulcrum pin 18 via the throttle valve 52. The throttle valve 52 allows a throttled lubricant flow from the first control chamber 28 to the second control chamber 30.

The control ring 14 is provided with a pressure relief valve 54 which connects the discharge zone 34 with the second control chamber 30, and more particularly, connects a final sector 56 of the discharge zone 34 with the second control chamber 30. The pressure relief valve 54 is defined by a radial groove which is provided at one axial side of the control ring 14. The final sector 56 of the discharge zone 34 is defined by one or maximally two of the pump chambers 24 which are located at the end of the discharge zone 34, i.e., the pump chambers 24 with the minimum pumping volume.

The connection between the final sector 56 of the discharge zone 34 and the second control chamber 30, realized by the pressure relief valve 54, avoids effectively high local differential pressure peaks in the discharge zone 34 so that the lubricant flow rate remains adapted to the engines demand, especially at high rotating speeds.

The present invention is not limited to embodiments described herein; reference should be had to the appended claims.

What is claimed is:

1. A variable displacement lubricant pump for providing a pressurized lubricant for an internal combustion engine, the variable displacement lubricant pump comprising:

a control ring configured to be shiftable, the control ring comprising a plurality of pump chambers and a pressure relief valve, the plurality of pump chambers being configured to rotate through a charge zone and a discharge zone;

a pump rotor comprising vanes configured to be radially slidable, the pump rotor being configured to rotate in the control ring;

a pretensioning element configured to push the control ring to a high pumping volume direction;

a first control chamber configured to push the control ring to a low pumping volume direction;

a second control chamber configured to push the control ring to the high pumping volume direction;

a pump outlet connected to the first control chamber;

a throttle valve configured to connect the first control chamber with the second control chamber, wherein, the pressure relief valve of the control ring connects the discharge zone to the second control chamber.

2. The variable displacement lubricant pump as recited in claim 1, wherein the pressure relief valve is provided as a radial groove in the control ring.

3. The variable displacement lubricant pump as recited in claim 1, wherein the pressure relief valve is arranged at a final sector of the discharge zone.

4. The variable displacement lubricant pump as recited in claim 1, further comprising a fulcrum pin, wherein the shiftable control ring is pivotably supported by the fulcrum pin.

5. The variable displacement lubricant pump as recited in claim 4, further comprising a first sealing element, wherein the first control chamber is arranged between the fulcrum pin and the first sealing element.

6. The variable displacement lubricant pump as recited in claim 4, further comprising a second sealing element, wherein the second control chamber is arranged between the fulcrum pin and the second sealing element.

7. The variable displacement lubricant pump as recited in claim 4, wherein the throttle valve is arranged adjacent to the fulcrum pin and is configured to bypass the fulcrum pin separating the first control chamber from the second control chamber.

8. The variable displacement lubricant pump as recited in claim 1, wherein the pump outlet is directly connected to the first control chamber.

9. The variable displacement lubricant pump as recited in claim 1, wherein the pretensioning element is a spring.

* * * * *